US008246327B2

(12) United States Patent
Otte, Jr. et al.

(10) Patent No.: US 8,246,327 B2
(45) Date of Patent: Aug. 21, 2012

(54) DUAL-CYLINDER ROCKING PISTON COMPRESSOR

(75) Inventors: William S. Otte, Jr., Stevensville, MI (US); Travis J. Dokey, Niles, MI (US); Gary W. Dunlap, Stevensville, MI (US); Steven T. Krempasky, Stevensville, MI (US)

(73) Assignee: Gast Manufacturing, Inc., Benton Harbor, MI (US)

( * ) Notice: Subject to any disclaimer, the term of this patent is extended or adjusted under 35 U.S.C. 154(b) by 980 days.

(21) Appl. No.: 11/421,677

(22) Filed: Jun. 1, 2006

(65) Prior Publication Data

US 2007/0280838 A1 Dec. 6, 2007

(51) Int. Cl.
*F04B 35/04* (2006.01)

(52) U.S. Cl. ..... 417/423.14

(58) Field of Classification Search ..... 417/415, 417/423.14, 360, 571, 363; 248/637
See application file for complete search history.

(56) References Cited

U.S. PATENT DOCUMENTS

| | | | | |
|---|---|---|---|---|
| 4,433,825 | A * | 2/1984 | Dernedde et al. | 248/672 |
| 5,231,917 | A * | 8/1993 | Wood | 92/186 |
| 5,265,646 | A * | 11/1993 | Richardson | 137/856 |
| 5,470,207 | A | 11/1995 | Shockey et al. | |
| 5,584,675 | A * | 12/1996 | Steurer et al. | 417/372 |
| 6,056,521 | A | 5/2000 | Leu et al. | |
| 6,126,410 | A * | 10/2000 | Kung et al. | 417/312 |
| 6,279,421 | B1 | 8/2001 | Faulkner et al. | |
| 6,331,101 | B2 * | 12/2001 | Leu et al. | 417/423.14 |
| 6,431,845 | B1 * | 8/2002 | Thomas et al. | 417/571 |
| 8,431,845 | | 8/2002 | Thomas et al. | |
| 6,443,713 | B1 * | 9/2002 | Weiss et al. | 417/413.1 |
| 6,485,266 | B2 * | 11/2002 | DeRuyter | 417/201 |
| 6,543,741 | B1 * | 4/2003 | Li et al. | 248/638 |

(Continued)

FOREIGN PATENT DOCUMENTS

DE 25 42 336 A1 3/1977

(Continued)

OTHER PUBLICATIONS

International Bureau, "International Preliminary Report on Patentability", Dec. 3, 2006, 10 Pages.

(Continued)

*Primary Examiner* — Devon Kramer
*Assistant Examiner* — Amene Bayou
(74) *Attorney, Agent, or Firm* — Miller, Matthias & Hull LLP

(57) ABSTRACT

A duel-cylinder reciprocating rocking piston-type compressor is disclosed with side foot mounts resulting in reduced compressor vibration and noise. An optimum vertical height for the foot mounts as well as an optimum lateral or axial position along the compressor body relative to the piston connecting rod are also disclosed. Specifically, the side foot mounts are mounted to the housing at a height falling in the range of 0.5 times the height of the drive shaft to about 1.5 times the height of the drive shaft. Further, an elevated o-ring gland or gasket is disclosed for sealing the heads to the valve plates. Still further, and improved valve plate design is disclosed that includes substantially flat valve plates, monolithically connected together through a raised central portion that defines tubes or passageways connecting the intake and output chambers associated with each cylinder. The result is a compressor with a shorter vertical height, that is lighter and that produces less noise and vibration without compromising output.

9 Claims, 10 Drawing Sheets

U.S. PATENT DOCUMENTS

| | | | | |
|---|---|---|---|---|
| 6,832,900 | B2 * | 12/2004 | Leu | 417/419 |
| 6,896,495 | B2 * | 5/2005 | Majerus et al. | 417/454 |
| 2001/0036410 | A1 * | 11/2001 | DeRuyter | 417/201 |

FOREIGN PATENT DOCUMENTS

| | | |
|---|---|---|
| DE | 25 42 336 | 3/1997 |

OTHER PUBLICATIONS

International Searching Authority, "*Invitation to Pay Additional Fees*", Aug. 7, 2007, 5 Pages.
International Searching Authority, "International Search Report and Written Opinion", Nov. 15, 2007, 16 Pages.

* cited by examiner

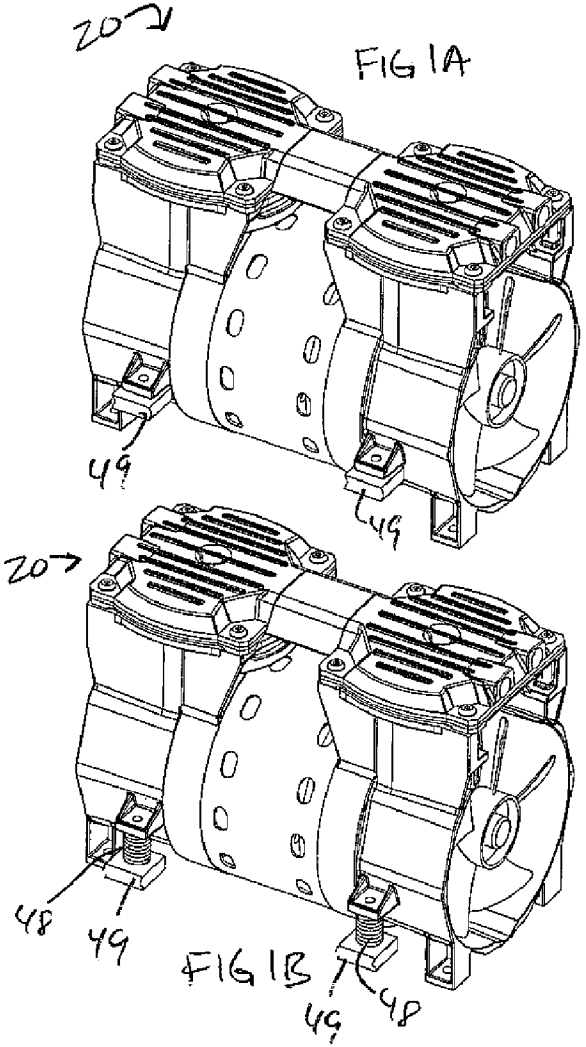
FIG 1A
FIG 1B
20
49
48
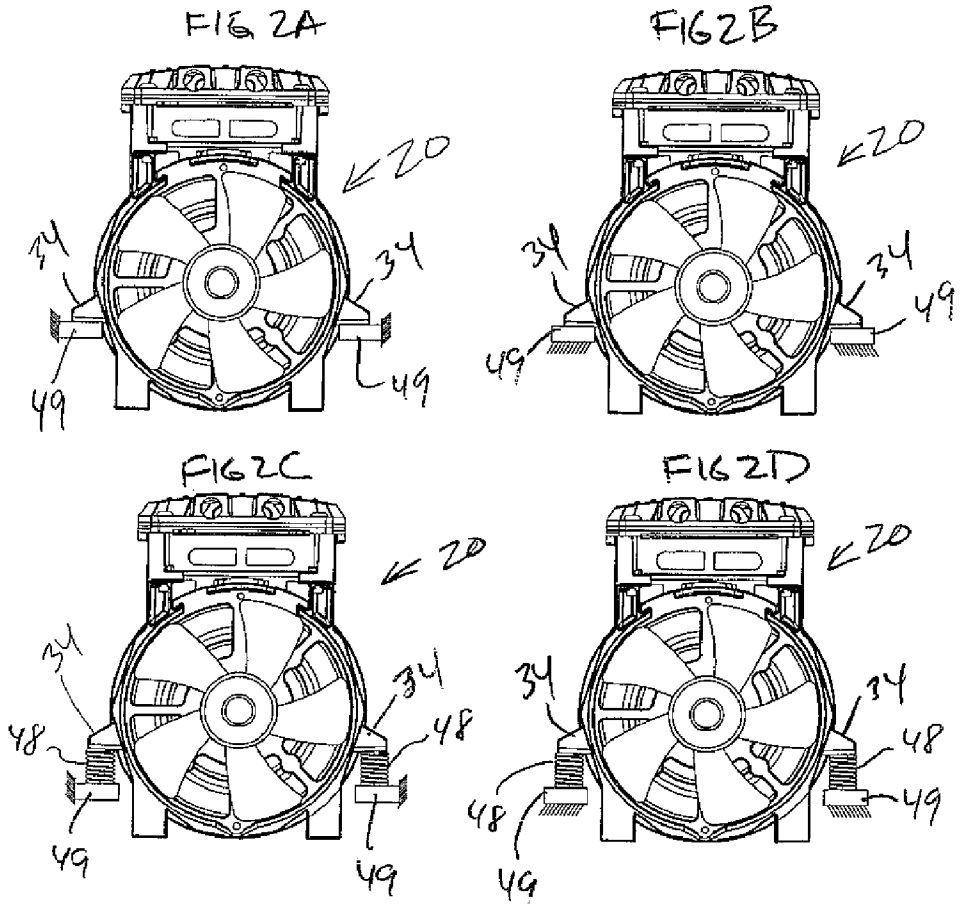
FIG 2A
FIG 2B
FIG 2C
FIG 2D
20
34
48
49

DUAL-CYLINDER ROCKING PISTON COMPRESSOR

BACKGROUND

1. Technical Field

A two-cylinder reciprocating compressor is disclosed with side foot mounts resulting in reduced compressor vibration and noise. An optimum height range as well as an optimum longitudinal or axial placement relative to the connecting rod for the foot mounts are also disclosed Further, an elevated o-ring gland or gasket is disclosed for sealing the heads to the valve plates. Still further, and improved head assembly design is disclosed that includes substantially flat valve plates, monolithically connected together through a raised central portion that defines tubes or passageways connecting the intake and output chambers associated with each cylinder 2. Description of the Related Art Dual cylinder, reciprocating compressors generally include a pair of pistons which reciprocate within a pair of cylinders, a pair of valve plates, and a pair of cylinder heads or a single piece cylinder head assembly. Each cylinder head includes an enclosed intake volume and exhaust volume. The gas or air is valved into and out of the compressor cylinders from the enclosed intake volumes in communication with the compressor inlet, to the enclosed exhaust volumes in communication with the compressor outlet In many compressor applications, compressor noise is an issue. For example, oxygen concentrators typically utilize a dual-cylinder compressor which must be located near the user (or patient) during operation. As a result, it is desirable to minimize the noise produced by the compressor.

Further, the design of the dual-cylinder reciprocating compressor continues to evolve as evidenced by U.S. Pat. Nos. 6,431,845 and 6,126,410, both of which are commonly assigned with the present application and which are incorporated herein by reference. The '410 patent discloses separate and relatively flat valve plates The intake and output chambers are formed by structurally connected heads that each have an irregularly shaped divider wall separating the intake and output chambers that are formed when the head is sealingly and abuttingly engaged with its respective valve plate. The outer periphery of each valve plate and the lower edge of each divider wall are disposed in a common plane. A planar but irregularly shaped gasket is disposed between each side of the unitary head and its respective valve plate, including the divider wall. The heads are connected together by a central section which includes two tubes or conduits that establish communication between the intake areas of each head and the output areas of each head respectively.

In contrast, the '845 patent discloses structurally separate heads or heads connected separately to structurally connected valve plates. Each valve plate forms the intake and output chambers with a straight divider wall separating the two chambers. The upper edge of the divider wall is coplanar with the outer periphery of valve plate, thereby enabling a relatively straightforward gasket design. The separate heads or heads are relatively flat and configuration.

In the '410 patent, the intake and output chambers are formed by the heads or heads; in contrast, the intake and output chambers of the '845 patent are formed by the structurally connected valve plates.

However, certain applications require compact and lightweight compressor design. It is believed that savings in terms of space (or height) as well as weight can be made by providing an interconnected head/gasket/valve plate design that is shorter and lighter than currently available designs, some of which are exemplified by the '410 and '845 patents as well as U.S. Pat. No. 6,056,521. Of course, any new design for a head/valve plate combination may also require a new gasket design as well.

Accordingly, new dual-cylinder rocking piston-type compressors are needed that are quieter, smaller and lighter without compromising output or performance.

SUMMARY OF THE DISCLOSURE

In satisfaction of the aforenoted needs, an improved two-cylinder reciprocating compressor is disclosed with side foot mounts resulting in reduced compressor vibration and, consequently, noise. An optimum height for the foot mounts is also disclosed.

Further, a three-dimensional gasket is disclosed for sealing the heads or heads to the valve plates that includes a raised portion that traverses the raised central section monolithically connecting the two valve plates and further providing communication between the intake sides of the valve plates and the output sides of the valve plates Also, an improved valve plate design is disclosed that includes substantially flat valve plates, monolithically connected together through a raised central portion that defines tubes or passageways connecting the intake and output chambers associated with each cylinder and defined by each valve plate and matching head.

In a refinement, a rocking piston compressor is disclosed which comprises a drive shaft passing through at least one piston, the drive shaft defining an axis The drive shaft and piston are accommodated in a housing. The housing comprises a body having a substantially U-shaped cross-section through which the axis of the drive shaft passes. The U-shaped body comprises an open top connected to a head assembly and two opposing sides connected by a bottom Each side of the U-shaped body is connected to at least one side foot mount. Each side foot mount comprises a bottom surface that is coplanar with the other side foot mount.

In a further refinement, the bottom surfaces of the side foot mounts are spaced vertically above a portion of the bottom of the U-shaped body that is in vertical alignment with the axis of the drive shaft by a first height. The axis of the drive shaft is spaced vertically above the portion of the bottom of the U-shaped body that is in vertical alignment with the axis of the drive shaft by a second height. The first height falls within the range of from about 1.5 times the second height to about 0.5 times the second height.

In a refinement, the first height is less than the second height.

In a refinement, the first height is in the range of from about 0.5 to less than 1.0 times the second height.

In still a further refinement, the side foot mounts ate also spaced axially or longitudinally along the compressor so that they are with in a proximity range of the closest connecting rod. In a preferred embodiment, the side foot mounts are spaced within 2 inches of either side of the closest connecting rod. In a still more preferred embodiment, the side foot mounts are spaced within about 1 inch of the closest connecting rod.

In a refinement, the drive shaft passes through two pistons and each side of the U-shaped body is connected to a pair of side foot mounts for total of four side foot mounts. Each foot mount is preferably spaced within about 2 inches laterally of the closest connecting rod and mote preferably within about 1 inch of the closest connecting rod In a refinement, the bottom of the U-shaped body is connected to at least one bottom foot mount.

An improved dual-cylinder rocking piston compressor is disclosed which comprises a drive shaft passing through two pistons. The drive shaft defines an axis. The drive shaft and piston are accommodated in a housing. The housing comprises a body having a substantially U-shaped cross-section through which the axis of the drive shaft passes. The U-shaped body comprises an open top connected to a head assembly and two opposing sides are connected by a bottom. Each side of the U-shaped body is connected to at least a pair of foot mounts. Each side foot mount comprises a bottom surface that is coplanar with the bottom surfaces of the other side foot mounts. The bottom surfaces of the side foot mounts are spaced vertically above a lowermost portion of the bottom of the U-shaped body that is in vertical alignment with the axis of the drive shaft by a first height The axis of the drive shaft is spaced vertically above the lowermost portion of the bottom of the U-shaped body by a second height. The first height falls in the range of from about 1.5 times the second height to about 0.5 times the second height.

A method for reducing vibration and noise imparted by a dual-cylinder rocking piston-tight compressor is disclosed which comprises:

providing a dual-cylinder rocking piston-type compressor comprising a drive shaft passing through two pistons, the drive shaft defining an axis, the drive shaft and piston being accommodated in a housing, the housing comprising a body having a substantially U-shaped cross-section through which the axis of the drive shaft passes, the U-shaped body comprising an open top connected to a head assembly, and two opposing sides connected by a bottom, the axis of the drive shaft being spaced vertically above the portion of portion of the bottom of the U-shaped body that is in vertical alignment with the axis of the drive shaft by a shaft height, connecting each side of the U-shaped body being at least one side foot mount, each side foot mount comprising a bottom surface that is coplanar with the bottom surfaces of the at least one other side foot mount, the side foot mounts being connected to the sides of the U-shaped body so that the bottom surfaces of the side foot mounts are spaced vertically above a portion of the bottom of the U-shaped body that is in vertical alignment with the axis of the drive shaft by a side foot mount height, wherein the connecting of the side foot mounts further comprises connecting the side foot mounts to the sides of the U-shaped body so that the side foot mount height falls in the range of from about 1.5 times the shaft height to about 0.5 times the shaft height.

In a refinement, the connecting step comprises connecting each side of the U-shaped body to a pair offside mounts.

In a refinement, the side foot mount height is less than the shaft height.

In a refinement, the side foot mount height falls within the range of from about 0.5 to less than 1.0 times the shaft height A head assembly for a compressor having dual cylinders is disclosed. The head assembly comprises a pair of valve plates connected by a raised central section. Each valve plate comprises an upper side that comprises a peripheral groove extending adjacent a perimeter of the valve plate and over a portion of the raised central section that connects the raised central section to said valve plate. Each valve plate further comprising a dividing groove that extends transversely across the valve plate between one end of said valve plate and the raised central section thereby dividing the upper side of the valve plate into an intake side and an output side. The head assembly also comprises a pair of heads with each valve plate being connected to one of the heads. Each head comprises a sidewall substantially perpendicular to the valve plate and extending adjacent the perimeter of the valve plate. Each side wall comprises an opening for receiving an end of the raised central section and each sidewall terminates at a lower mating surface that extends around the periphery of the sidewall and over the raised central section. Each head further comprises a divider wall that terminates in a lower mating surface that is in alignment with the divider groove of the valve plate to which it is connected. The divider wall of each head defines a intake volume and an output volume. The head assembly further comprising a pair of unitary gaskets. Each gasket comprising an outer peripheral portion disposed in the peripheral groove of its respective valve plate and a divider portion disposed in the dividing groove of its respective valve plate.

In a refinement, a portion of each unitary gasket extends through the portion of the peripheral groove that extends over the portion of the raised central section that is connected to its respective valve plate.

In a refinement, the valve plates are monolithically connected together by the raised central section.

In a refinement: the raised central section provides fluid communication between the intake sides of each valve plate and between the output sides of each valve plate.

A three-dimensional gasket for a dual-cylinder rocking piston-type compressor is also disclosed. The disclosed gasket comprises an outer peripheral section that forms a closed loop and the outer peripheral section of the gasket further comprises at least one raised portion. The gasket also comprises a dividing section that extends between the raised portion of the peripheral section and an opposing and of the peripheral section.

In a refinement, the dividing section divides the peripheral section into substantially mirror halves.

In a refinement, the gasket is unitary in this structure.

Other advantages and features will be apparent from the following detailed description when read in conjunction with the attached drawings

BRIEF DESCRIPTION OF THE DRAWINGS

For a more complete understanding of the disclosed methods and apparatuses, reference should be made to the embodiment illustrated in greater detail on the accompanying drawings, wherein:

FIG. 1A is a perspective view of the dual-cylinder rocking piston compressor shown in FIG. 1 further illustrating horizontal mounting surfaces.

FIG. 1B is a perspective view of a dual-cylinder rocking piston compressor shown in FIGS. 1-1A further illustrating horizontal mounting surfaces and spring members disposed between the side foot mounts and the horizontal mounting surfaces.

FIG. 2A is in an end view of the compressor shown in FIGS. 1-2 further illustrating horizontal mounting surfaces.

FIG. 2B is in an end view of the compressor shown in FIGS. 1-2 further illustrating alternative horizontal mounting surfaces.

FIG. 2C is in an end view of the compressor shown in FIG. 1-2 further illustrating horizontal mounting surfaces and spring members disposed between the side foot mounts and the horizontal mounting surfaces FIG. 2D is in an end view of the compressor shown in FIGS. 1-2 further illustrating horizontal mounting surfaces and spring members disposed between the side foot mounts and the horizontal mounting surfaces.

It should be under stood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein

DETAILED DESCRIPTION OF THE PRESENTLY PREFERRED EMBODIMENTS

Figure 1:
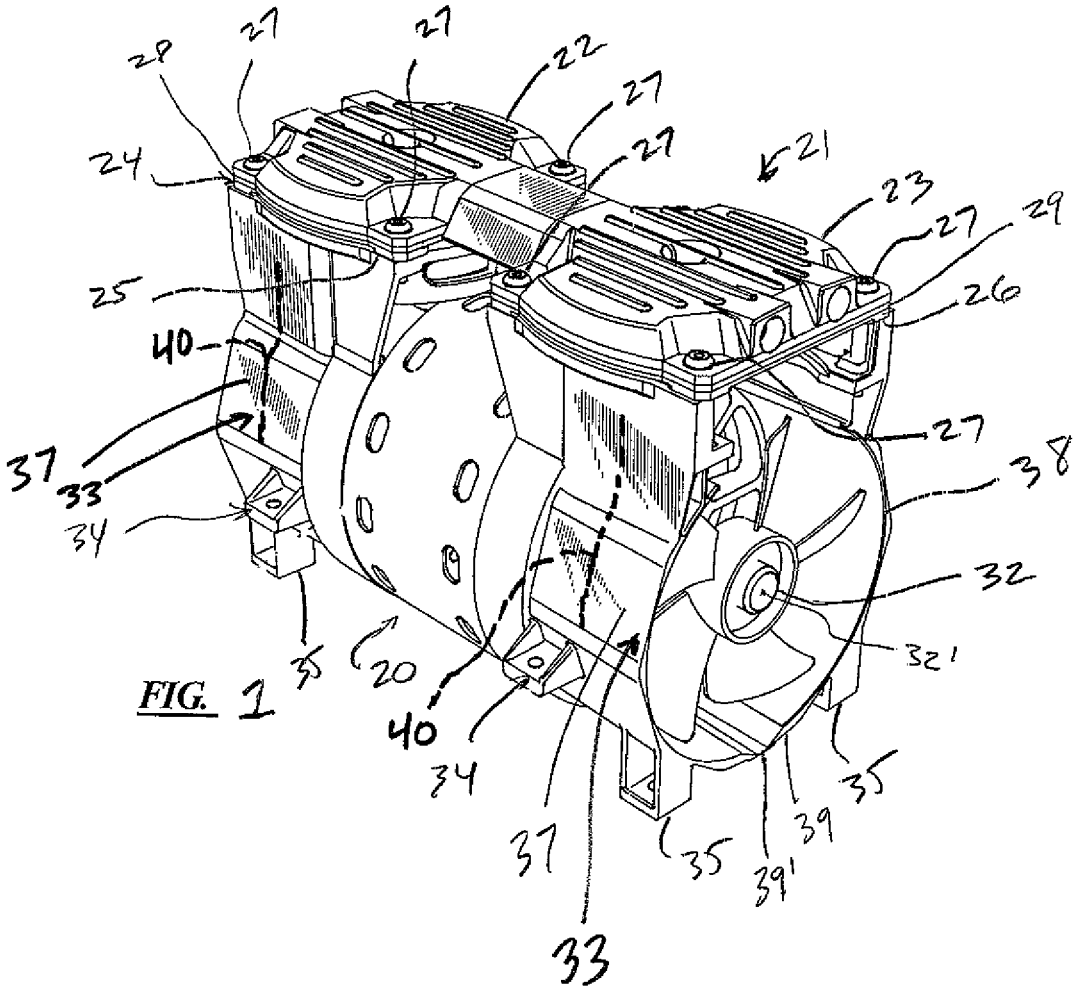
FIG.1 is a perspective view of a dual-cylinder rocking piston compressor made in accordance with this disclosure.

Turning first to FIG. 1, a compressor 20 is disclosed which includes a head assembly 21 that will be discussed in greater detail below in connection with FIGS. 8-18 Briefly, the head assembly 21 includes separate heads 22, 23 connected to a valve plate assembly 24 which includes valve plates 25, 26 connected to the heads 22, 23 respectively by a plurality of threaded fasteners shown generally at 27 with gaskets 28, 29 sandwiched respectively therebetween. For purposes of this disclosure, is also important to note the position of the drive shaft 32 which passes through to rocking pistons (not shown) disposed inside the housing 33 of the compressor 20. For details regarding the operation of the pistons, see U.S. Pat. No. 6,126,410, which is incorporated herein by reference The housing 33 of the compressor 20 also includes a plurality of foot mounts, two of which are side foot mounts shown generally at 34 and bottom foot mounts, three of which are shown generally at 35.

The housing 33 is generally U-shaped with sidewalls shown generally at 37, 38 and a bottom wall shown generally at 39. It will be noted that a portion of the bottom wall 39 that is in vertical alignment with an axis 32' of the drive shaft 32 and is the lowermost portion 39' of the housing 33 as explained in greater detail below in connection with FIG. 2.

Figures 2, 12:
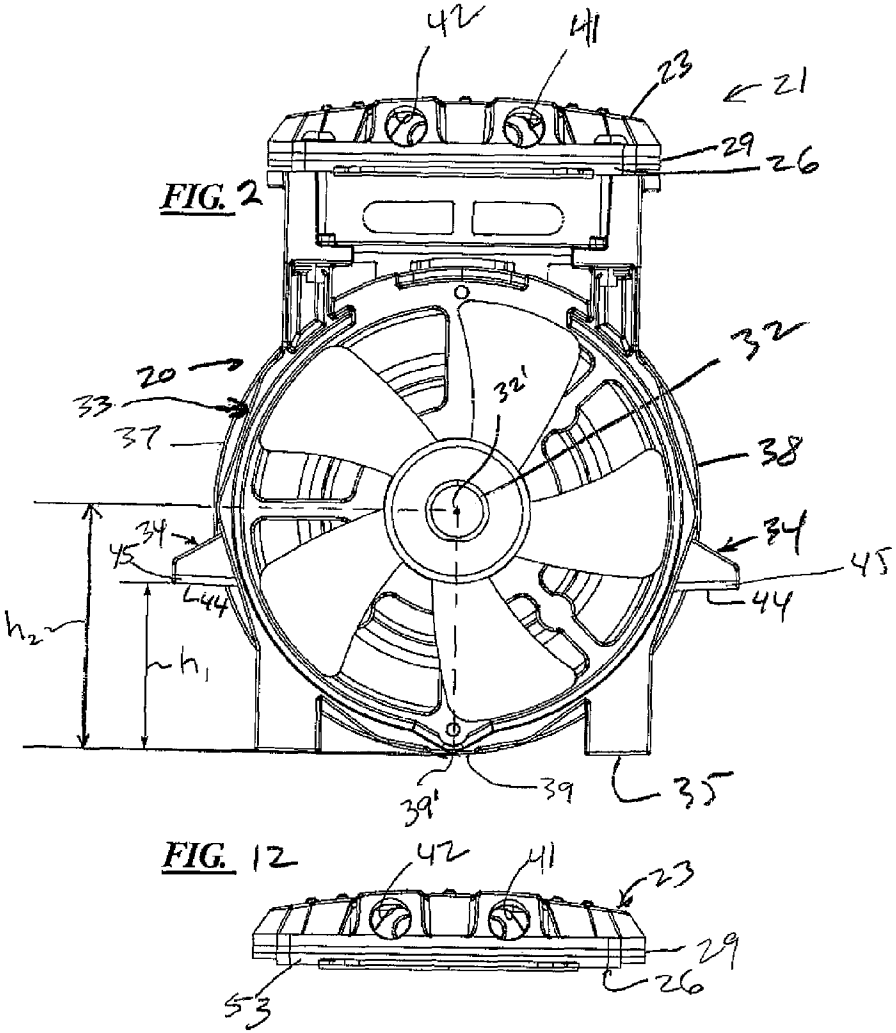
FIG. 2 is in an end view of the compressor shown in FIG. 1
FIG. 12 is an end view of the of valve plate assembly shown in FIGS. 8-11.

Turning to FIG. 2, an end view of the compressor 20 and head assembly 21 is shown. Each head 22, 23 includes an inlet port 41 and an outlet port 42. Again, the details of the operation of the compressor 20 can be found in the '420 patent cited above. Most dual-cylinder rocking piston-type compressors like that shown at 20 in FIGS. 1-2 impart a substantial amount of noise and vibration. Because the compressor 20 and those like it are excellent for oxygen concentrators and other related medicinal applications, quieter compressors that impart less vibration are desirable. To satisfy this need, the compressor 20 is equipped with side foot mounts shown at 34. The foot mounts 34 are attached to the sides 37, 38 of the housing 33 respectively. Each side foot mount 34 includes a lower mounting surface 44 which can be used to define the effective height of the side foot mounts 34 relative to the lowermost portion 39' of the compressor 20 In this case, the lowermost portion of the compressor 20 is defined as the bottom 39 of the housing 33 that is in vertical alignment with the vertical axis 32' of the drive shaft 32. This lowermost portion of the bottom 39 of the housing 33 is designated as 39'.

Thus, the effective height of the side foot mounts 34 as shown in FIG. 2 is indicated as $h_1$. Meanwhile, the effective height of the axis 32' of the drive shaft 32, or the vertical distance between the axis 32' and the lowermost portion 39' of the housing 33 is indicated as $h_2$. In a preferred embodiment, the relationship between $h_1$ and $h_2$ can be expressed by the following formulas:

$$0.5\ h_2 \leqq h_1 \leqq 1.5\ h_2$$

or $$h_1 = h_2 +/- 0.5\ h_2$$

Further, the side foot mounts 34 are also preferably spaced laterally along the compressor 20 so that they are within a range of about +/−2 inches from the closest connecting rod. Lines indicating the relative positions of the connecting rods of the pump 20 are shown in phantom at 40 in FIGS. 1 and 4 More preferably, the side foot mounts 34 are disposed within about 1 inch of the nearest connecting rod.

It is been found that the combination of elevating the foot mounts 34 in the manner disclosed herein increases the stability of the compressor 20 by a vertically locating the mounts 34 closer to the center of mass of the compressor 20. The new mount location disclosed herein reduces the rotating moments that can cause the compressor 20 to tip or become unstable during transportation and it will be noted that sometimes the compressors 20 are used in mobile applications.

Also in a preferred embodiment as shown in FIG. 2, the bottoms or lowermost portions of the side foot mounts 34 can be coated with a rubber or an elastomeric material shown at 45.

Figure 3:
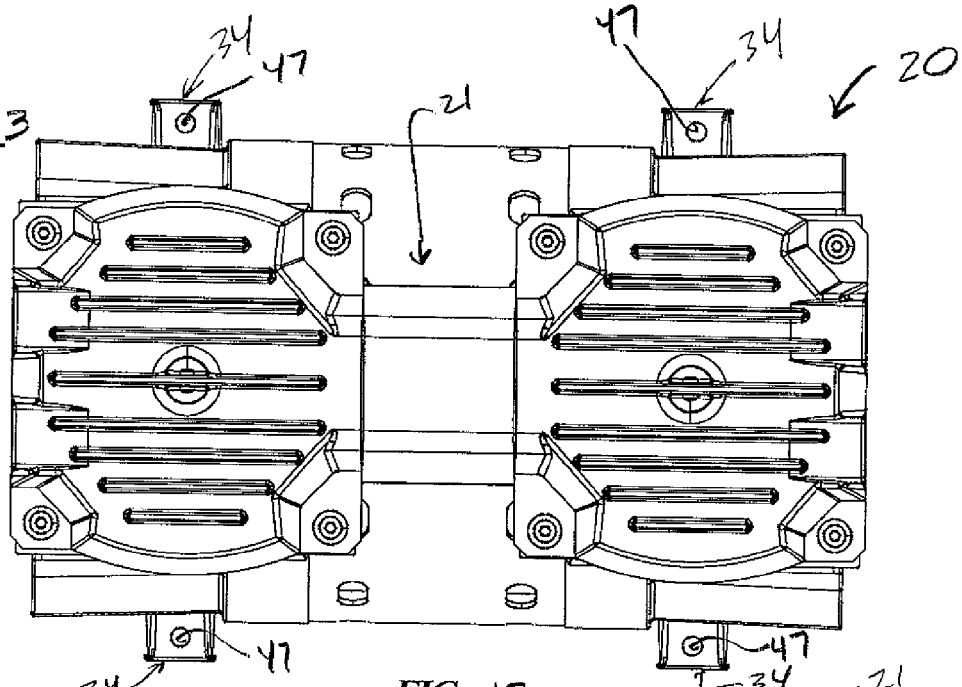
FIG. 3 is a top plane view of the compressor shown in FIGS. 1 and 2.
Figure 4:
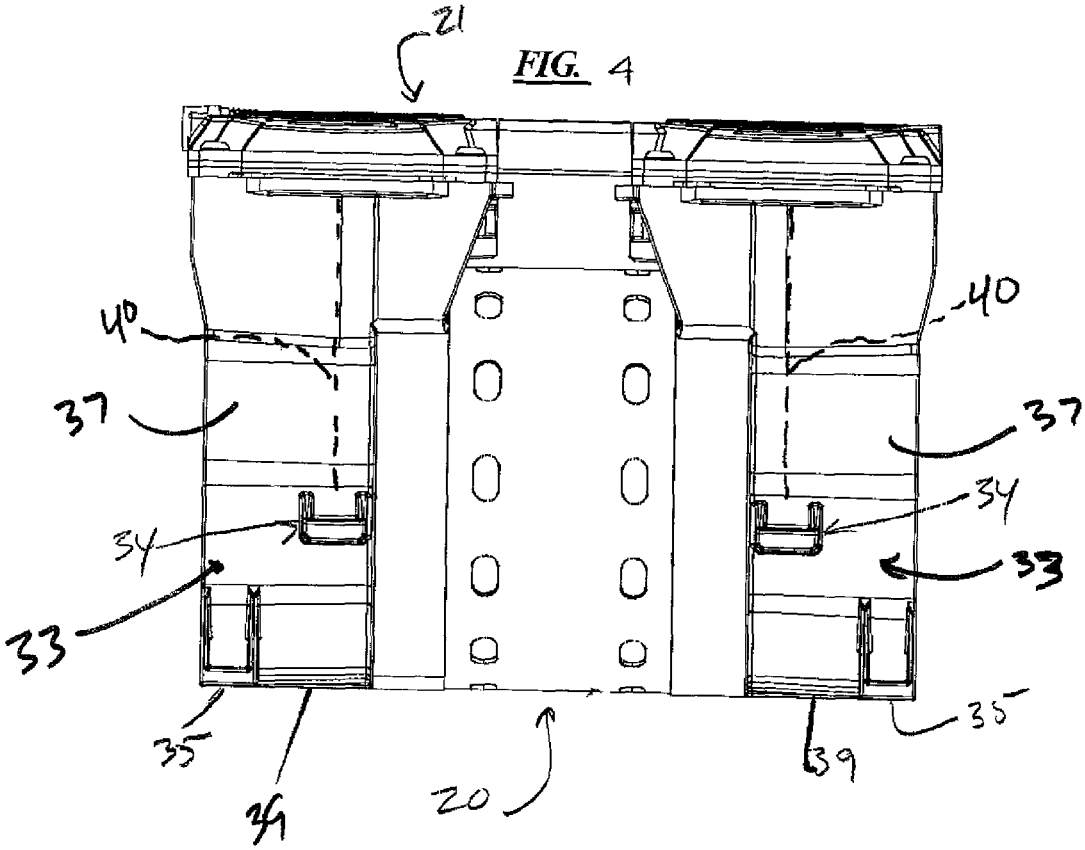
FIG. 4 is a side plan view of the compressor shown in FIGS. 1-3.
Figure 5:
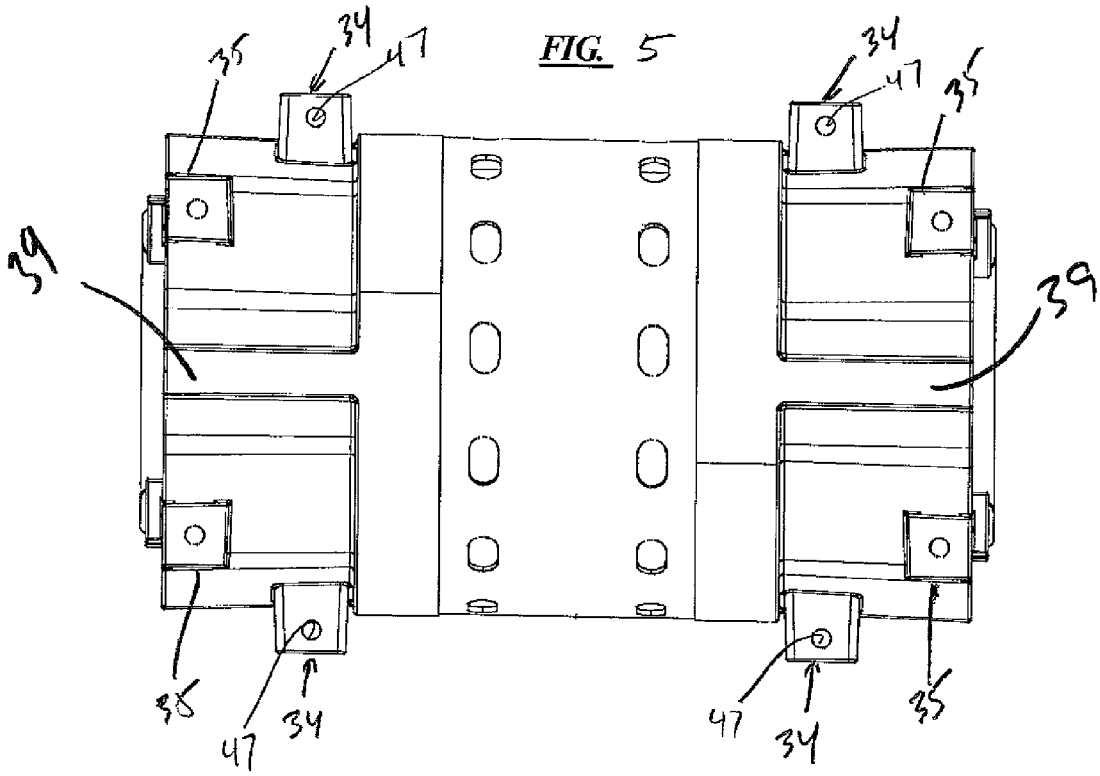
FIG. 5 is a bottom plan view of the compressor shown in FIGS. of 1-4

Turning to FIGS. 3-5, the positioning of the side foot mounts 34 are shown in top, side and bottom views respectively. Each foot mount 34 may include a through-hole 47 for connecting the foot mounts 34 to spring members 48 as shown in FIG. 2C-2D and FIG. 1B.

Generally, FIGS. 1A-1B and 2A-2D illustrate various mounting options for the compressor 20. For the oxygen concentrator application, the compressor 20 will most likely be mounted within some sort of cabinetry. Hence, some sort of horizontally disposed mounting surface or ledge shown generally at 49 will be provided. FIG. 2A illustrates horizontal mounting surfaces 49 laterally attached to a support structure FIG. 2B illustrates horizontal support surfaces 49 mounted on top of another horizontal support structure. FIG. 2C illustrates horizontal support surfaces 49 with spring members 48 disposed between the foot mounts 34 and the laterally supported surfaces 49 while FIG. 2D illustrates spring members disposed between the foot mounts 34 in the horizontally supported surfaces 49.

Figure 6:
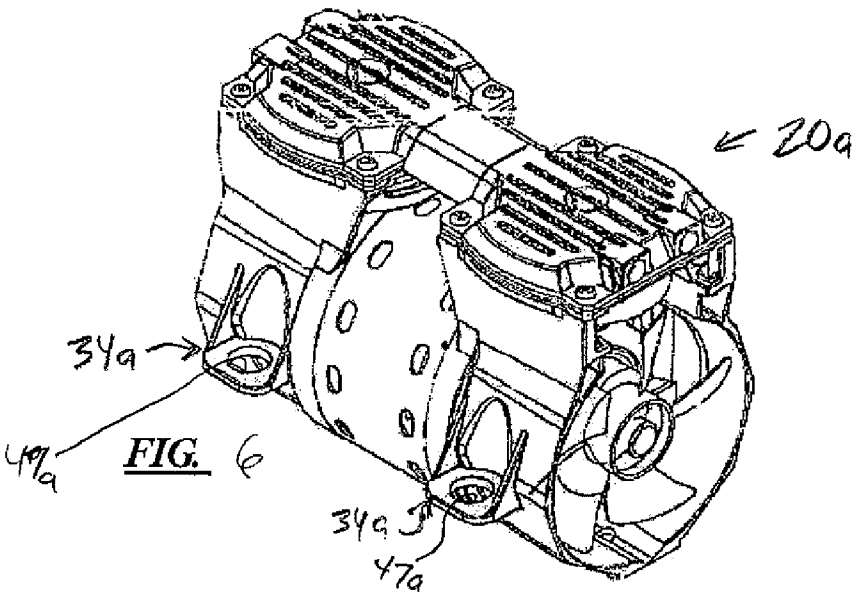
FIG. 6 is a perspective view of an alternative embodiment.
Figure 7:
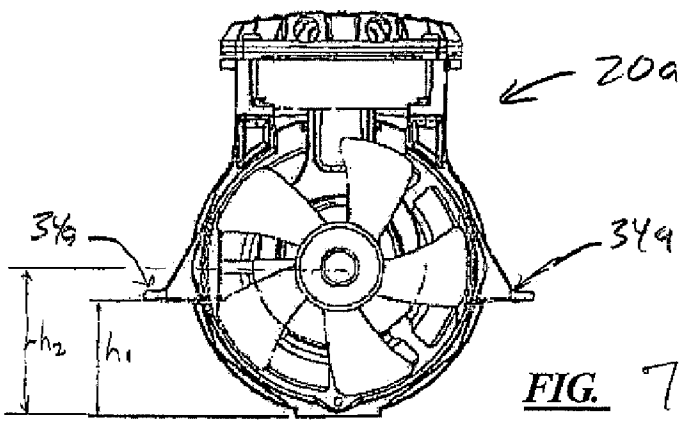
FIG. 7 is an end view of the compressor shown in FIG. 6.

Turning to FIGS. 6-7, and alternative embodiments to the compressor 20 are shown generally at 20*a*. The compressors 20*a* include differently configured side foot mounts 34*a*. The primary differences between the foot mounts 34 (FIG. 1-5) and the foot mounts 34*a* being the size of the through-holes 47, 47*a* and the lateral dimensions of the mounts.

Figure 8:
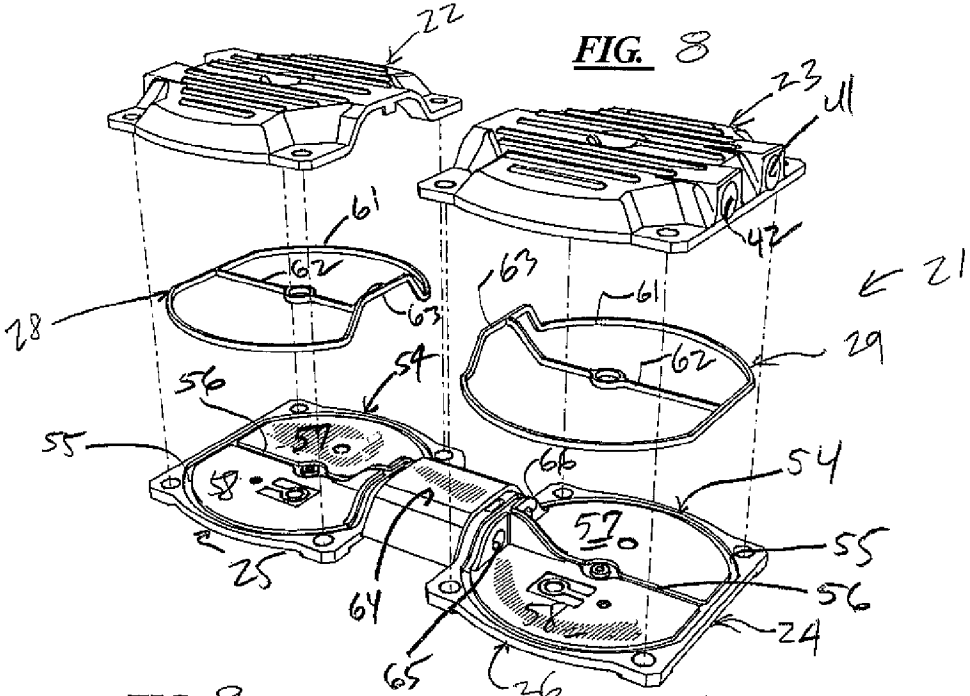
FIG. 8 is an exploded top perspective view of the head assembly for the compressors shown in FIGS. 1-7.
Figure 9:
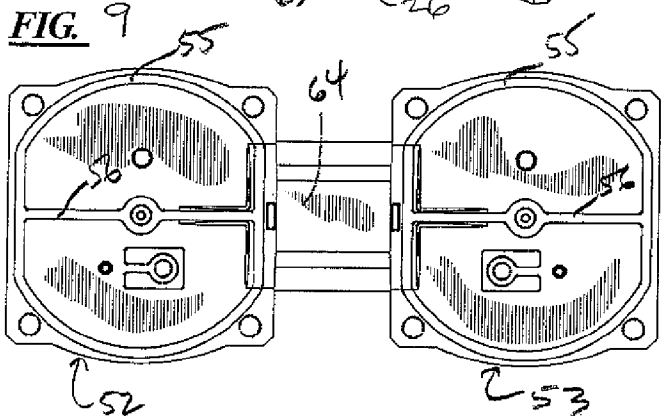
FIG. 9 is a top plan view of the valve plate of the head assembly shown in FIG. 8.

Turning to FIGS. 8-18, the head assembly 21 and improved gaskets 28, 29 are shown and described. Regarding FIG. 8, the assembly 21 includes the two heads 22, 23 which are connected to the unitary valve plate 26 that includes the plate members 25, 26. Each plate member 25, 26 includes a peripheral notch shown generally at 54. However, the notch 54 includes an outer peripheral section 55 and a central dividing section 56. The dividing section 56 divides each valve plate into and intake portion 57 and output portion 58. Consequently, each gasket 28, 29 includes an outer peripheral loop 61 that is divided into minor halves by the dividing section 62. The gaskets 28, 29 also includes a raised section 63 which traverses either end of the raised central section 64 that connects the two valve plate 25, 26 together. The raised central section 64 also includes conduits 65, 66 which provide fluid communication between the intake sides 57 of the valve plates 25, 26 and output sides 58 of the valve plates 25, 26 respectively. The peripheral groove 55 of each valve plate traverses the raised central section at either end thereof as shown in FIG. 8. Therefore, to effectuate a good seal between the heads 22, 23 and the valve plates 25, 26, the gaskets 28, 29 need the specially designed to raised sections shown at 63 in FIG. 8. FIG. 9 is a top plan view of the valve plates 25, 26 and the raised the raised central section 64 that connects the valve plates 25, 26 both structurally and in terms of fluid communication FIG. 9 also shows the peripheral and dividing grooves 55, 56 of the valve plates 25, 26.

Figure 13:
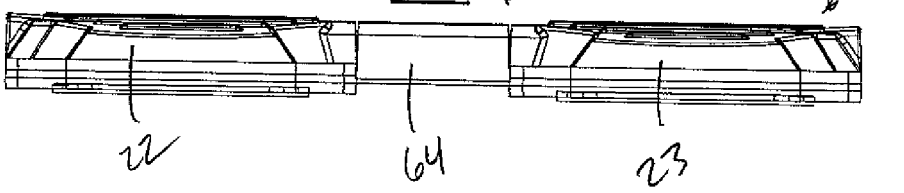
FIG. 13 is a side plan view of the valve plate assembly shown in FIGS. 8-12.
Figure 10:
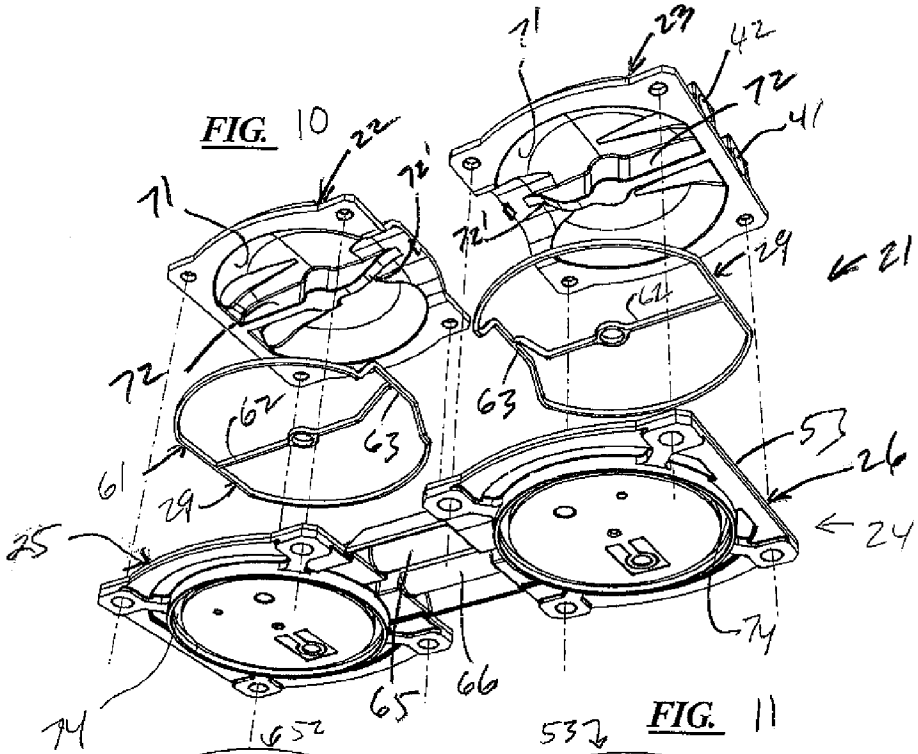
FIG. 10 is an exploded a perspective view of the head assembly shown in FIGS. 8-9.
Figure 11:
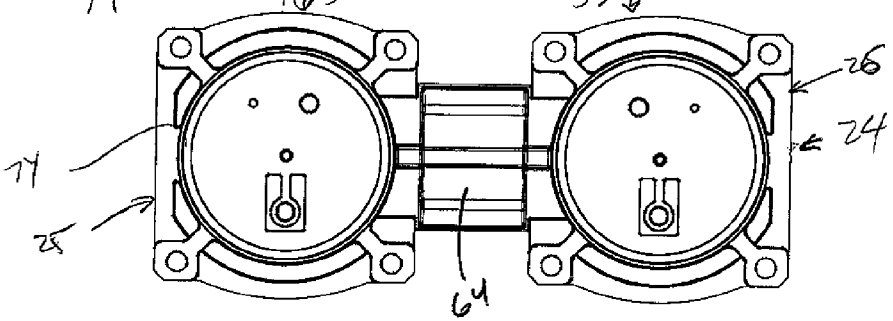
FIG. 11 is a bottom plan view of the valve plate shown in FIGS. 8-10
Figure 16:
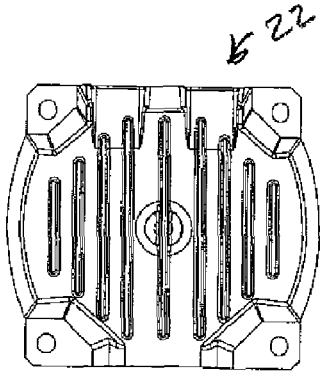
FIG. 16 is atop plan view of one of the heads shown in FIGS. 1-4, 6-8, 10, and 12-15.
Figure 17:
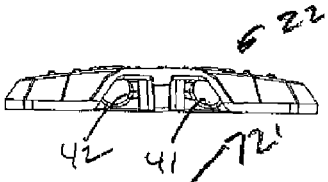
FIG. 17 is an end view of one of the heads shown in FIGS. 1-4, 6-8, 10, and 12-16.
Figure 18:
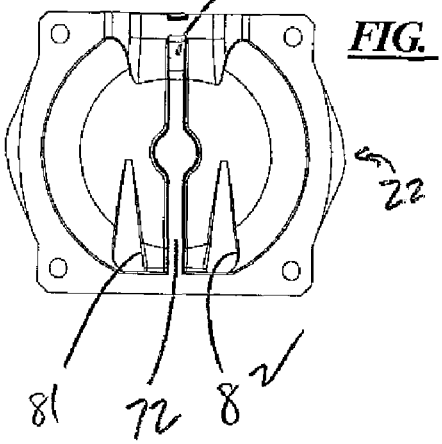
FIG. 18 is a bottom plan view of one of the heads shown in FIGS. 1-4, 6-8, 10, and 12-17.

FIG. 10 is a bottom perspective exploded view of the head assembly 21. It will be noted that the heads 22, 23 include sidewalls shown generally at 71 and the dividing wall shown generally at 72. The dividing walls 72 are in general alignment with the dividing sections 62 of the gaskets 28, 29 to provide an effective sandwiching seal between the dividing walls 72 and the valve plates 25, 26 along the dividing grooves 56. The dividing walls 72 include tapered sections 72' to accommodate for the ends of the raised central section 64. FIG. 10 also provides a good view of the communication conduits 65, 66 extending between the output chambers 58 and intake chambers 57 respectively. The lower groove 74 shown in each valve plate 25, 26 respectively in FIGS. 10-11 accommodates upper ends of the cylinders (not shown, see U.S. Pat. No. 6,126,410) FIGS. 12-13 provide end and side views respectively of the head assembly 21.

Figure 14:
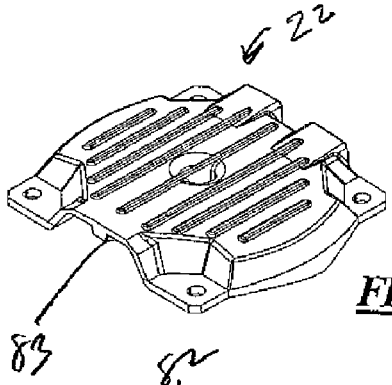
FIG. 14 is a top perspective view of one of the heads shown in FIGS. 1-4, 6-8, 10, and 12-13.
Figure 15:
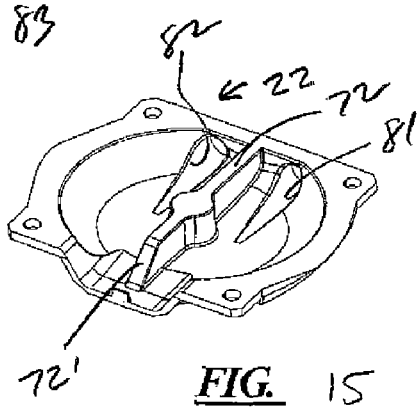
FIG. 15 is a bottom perspective view of one of the heads shown in FIGS. 1-4, 6-8, 10, and 12-14.

FIGS. 14-18 provide numerous views of the heads 22, 23, which are identical and structure and therefore are referred to with 22 here. As shown in FIG. 15, each head includes openings 81, 82 for communicating with the conduits 65, 66 respectively (see FIG. 11). As seen in FIG. 14, the head 22 also includes a raised section 83 for accommodating to the raised central section 64 as discussed above.

Thus, an improved compressor 20 is disclosed which produces less vibration and less noise than predecessor models. Further the compressor 20 is shorter and lighter due to the head assembly 21 which combines a flat valve plate assembly 24 with low profile had covers 22, 23, thereby conserving space and weight. A unique gaskets system in the form of the gaskets 29 is also provided. An improved method for reducing sound and vibration by relocating or placing foot mounts on the sides of the compressor housing as opposed to on the bottom of the compressor housing is also disclosed. Without being down by theory, it is respectfully submitted that placing foot mounts on the sides of the compressor substantially reduces noise and vibration thereby making a compressor more versatile and useful in environments where noise and vibration are problematic.

While only certain embodiments have been set forth, alternatives and modifications will be apparent from the above description to those skilled in the art. These and other alternatives are considered equivalents and within the spirit and scope of this disclosure and the appended claims.

What is claimed:

1. A rocking piston compressor comprising:

a drive shaft having a proximal portion passing through at least one proximal piston and a distal portion passing through at least one distal piston, the drive shaft defining a horizontal axis, the proximal portion of the drive shaft and proximal piston being accommodated in a proximal housing, the distal portion of the drive shaft and distal piston being accommodated in a distal housing, the proximal and distal housings being connected to and disposed on opposite sides of a cylindrical motor housing, the proximal and distal housings each comprising proximal and distal bodies respectively, the proximal and distal bodies each having a substantially U-shaped cross-section through which the horizontal axis of the drive shaft passes, the proximal and distal bodies each comprising an open top connected to a head assembly and two opposing sides connected by a bottom, the proximal and distal bodies each being directly connected to a pair of side foot mounts disposed opposite to each other relative to their respective bodies, each side foot mount comprising a flat and horizontal bottom surface that is coplanar with the other side foot mount disposed opposite its respective body, the bottom surfaces of the side foot mounts each being spaced vertically above a portion of the bottom of its respective body that is in vertical alignment with the horizontal axis of the drive shaft by a first height, the bottom surfaces of the side foot mounts extending outward from the opposing sides of their respective bodies and beyond the opposing sides of their respective bodies so that the side foot mounts can support each side of their respective bodies of the compressor over a horizontal opening that is wider than the opposing sides of the proximal and distal bodies and the cylindrical motor housing but not as wide as a horizontal distance between the pair of side foot mounts connected to the proximal body and the pair of side foot mounts connected to the distal body, each side foot mount being fixedly connected to their respective bodies and comprising a hole with a vertical axis for receiving a vertical fastener for suspending the compressor in the horizontal opening, the compressor further comprising four bottom foot mounts disposed beneath the proximal and distal bodies and not extending laterally beyond the proximal and distal bodies, each bottom foot mount comprising a vertical outer wall that is disposed laterally inside of all connections between the side foot mounts and the U-shaped body to provide vertical clearance below each side foot mount which prevents the bottom foot mounts from interfering with placing the side foot mounts outside of the horizontal opening for suspending the compressor in the horizontal opening when the compressor is lowered vertically into the horizontal opening, the axis of the drive shaft being spaced vertically above the portion of the bottom of the U-shaped body that is in vertical alignment with the axis of the drive shaft by a second height, the first height falling in the range of less than the second height to greater than 0.5 times the second height.

2. The rocking piston compressor of claim 1, wherein each side foot mount is located laterally along its respective body so that each side foot mount is disposed within about 2 inches of a piston connecting rod.

3. A dual-cylinder rocking piston compressor comprising:

a drive shaft passing through a proximate piston disposed in a proximate body and a distal piston disposed in a distal body with a cylindrical motor housing disposed between the proximal and distal bodies, the drive shaft defining an axis, the proximal and distal bodies being U-shaped and comprising an open top connected to a head assembly, and two opposing sides connected by a bottom, each side of the proximal and distal bodies being directly connected to at least a pair of side foot mounts, each side foot mount comprising a flat and horizontal bottom surface that is coplanar with the bottom surfaces of the other side foot mounts, the bottom surfaces of the side foot mounts being spaced vertically above a lowermost portion of the bottom of its respective body that is in vertical alignment with an axis of the drive shaft by a first height, the bottom surfaces of the side foot mounts extending outward from the opposing sides of their respective bodies and beyond the opposing sides of their respective bodies so that the side foot mounts can support the compressor over a horizontal opening wider than the opposing sides of the proximal and distal bodies and wider than the motor housing but not as wide as a horizontal distance between two side foot mounts disposed opposite the proximal and distal bodies, each side foot mount being fixedly connected to its respective body and comprising a horizontal hole for receiving a vertical fastener for suspending the compressor in the horizontal opening, the compressor further comprising four bottom foot mounts disposed beneath the proximal and distal bodies and not extending laterally beyond the proximal and distal bodies or the motor housing, each bottom foot mount comprising a vertical outer wall that is disposed laterally inside of all connections between the side foot mounts and their respective bodies to provide vertical clearance below each side foot mount which prevents the bottom foot mounts from interfering with placing the side foot mounts outside of the horizontal opening for suspending the compressor in the horizontal opening when the compressor is lowered vertically into the horizontal opening, the axis of the drive shaft being spaced vertically above the lowermost portion of the bottoms of the proximal and distal bodies by a second height, the first height falling in the range of from less than the second height to greater than 0.5 times the second height.

4. The rocking piston compressor of claim 3, wherein the side foot mounts are connected to their respective bodies at a longitudinal position within 2 inches of a corresponding longitudinal position of a piston connecting rod.

5. A method for reducing vibration and noise imparted by a dual-cylinder rocking piston-type compressor, comprising:

providing a dual-cylinder rocking piston-type compressor comprising a drive shaft passing through a distal piston and a proximal piston, the proximal piston disposed in a proximal body, the distal piston disposed in a distal body, the drive shaft defining an axis, the proximal and distal bodies each having a substantially U-shaped cross-section through which the axis of the drive shaft passes, the proximal and distal bodies each comprising an open top connected to a head assembly, and two opposing sides connected by a bottom, the axis of the drive shaft being spaced vertically above the bottoms of the proximal and distal bodies that are in vertical alignment with the axis of the drive shaft by a shaft height, fixedly and directly connecting each side of the proximal and distal bodies to at least a pair of side foot mounts, each side foot mount comprising a flat and horizontal bottom surface that is coplanar with the bottom surface of the at least one other side foot mount disposed opposite each other relative to their respective bodies, each side foot mount also comprising a horizontal hole with a vertical axis for receiving a vertical fastener, the side foot mounts being connected to the sides of the proximal and distal bodies so that the bottom surfaces of the side foot mounts are spaced vertically above portions of the bottoms of the proximal and distal bodies that are in vertical alignment with the axis of the drive shaft by a side foot mount height, the bottom surfaces of the side foot mounts extending outward from the opposing sides of the proximal and distal bodies and beyond the opposing sides of the proximal and distal bodies so that the side foot mounts can support the compressor over a horizontal opening wider than the opposing sides of the proximal and distal bodies but not as wide as a horizontal distance between the side foot mounts disposed opposite their respective bodies from each other, the compressor further comprising four bottom foot mounts disposed beneath the proximal and distal bodies and not extending laterally beyond the proximal and distal bodies or the cylindrical motor housing, each bottom foot mount comprising an vertical outer wall that is disposed laterally inside of all connections between the side foot mounts and the proximal and distal bodies to provide vertical clearance below each side foot mount which prevents the bottom foot mounts from interfering with placing the side foot mounts outside of the horizontal opening for suspending the compressor in the horizontal opening when the compressor is lowered vertically into the horizontal opening, wherein the fixedly connecting of the side foot mounts further comprises fixedly connecting the side foot mounts to the sides of their respective bodies so that the side foot mount height falls in the range of from less than the shaft height to greater than 0.5 times the shaft height.

6. The method of claim 5, wherein the connecting step comprises connecting each side mounts at a lateral position within about 2 inches of a piston connecting rod.

7. A head assembly for a compressor having dual cylinders, the head assembly comprising:

a pair of flat, horizontal valve plates, each comprising two side sections and an end disposed therebetween, the two side sections of each valve plate being coplanar with respect to each other and the two side sections of the other valve plate, the side sections of each valve plate being connected on opposite sides of a common raised central section that extends vertically above the side sections and ends of the pair of valve plates so that an upper surface of the raised central section is not coplanar with the side sections and ends of the pair of valve plates, each valve plate comprising an upper side that comprises a peripheral groove extending adjacent a perimeter of the valve plate and upward and over a portion of the raised central section that connects the raised central section to said side sections of said valve plate, the side sections and end of each valve plate not including an upwardly extending walls, each valve plate further comprising a dividing groove extending transversely across its respective valve plate from the end section of said valve plate and upward to the raised central section thereby dividing the upper sides of each valve plate into an intake side and an output side, a pair of heads with each valve plate being connected to one of the heads, each head comprising a sidewall extending downward to the valve plate and adjacent the perimeter of the valve plate, each side wall comprising an opening for being received in a slot in an end of the raised central section, and each sidewall terminating at a lower mating surface that extends around the periphery of the sidewall and up and over the raised central section, each head further comprises a divider wall that terminates at a lower mating surface that is in alignment with the divider groove of the valve plate to which it is connected, the divider wall of each head defining a intake volume and an output volume, each head further comprising an upper surface that is coplanar with the upper surface of the raised central section, a pair of unitary gaskets, each gasket comprising an outer peripheral portion comprising three coplanar sections comprising an end section disposed between a pair of side sections, the side sections being connected to a raised portion for extending up and over the common raised section of the valve plate, the outer peripheral portion of each unitary gasket disposed in the peripheral groove its respective valve plate and a divider portion extending downward from the raised portion to the end section and that is disposed in the dividing groove of its respective valve plate.

8. The head assembly of claim 7 wherein the valve plates are monolithically connected together by the raised central section.

9. The head assembly of claim 8 wherein the raised central section provides fluid communication between the intake sides of each valve plate and between the output sides of each valve plate.

* * * * *